United States Patent [19]

Kendrick, Jr.

[11] 3,997,890

[45] Dec. 14, 1976

[54] ALARM SYSTEM WITH SUPERVISORY SYSTEM TO DETECT SEVERING OR BRIDGING OF DETECTION SWITCHES

[76] Inventor: Embry Mayes Kendrick, Jr., 1165 N. Coleman Road, Roswell, Ga. 30075

[22] Filed: June 11, 1974

[21] Appl. No.: 478,422

[52] U.S. Cl. ..... 340/285; 307/321; 340/274 R; 340/276; 340/409

[51] Int. Cl.[2] ..... G08B 13/00

[58] Field of Search ..... 340/285, 409, 274 R, 340/276, 213 R; 307/321, 116, 130, 112; 328/208

[56] References Cited

UNITED STATES PATENTS

| | | | |
|---|---|---|---|
| 2,624,792 | 1/1953 | Fruh | 340/274 |
| 3,440,636 | 4/1969 | Sliman | 340/285 |
| 3,603,949 | 9/1971 | Walthard | 340/409 |
| 3,624,646 | 11/1971 | Weiss | 340/285 |
| 3,673,589 | 6/1972 | Barret et al. | 340/276 |
| 3,821,733 | 6/1974 | Reiss et al. | 340/409 |
| 3,924,256 | 12/1975 | Cohen | 340/409 |

*Primary Examiner*—Glen R. Swann, III
*Attorney, Agent, or Firm*—Beveridge, DeGrandi, Kline & Lunsford

[57] ABSTRACT

A tamper proof detector circuit for use in an alarm system and an integral switch for use therein. The integral switch is comprised of a housing which encloses an alarm condition sensing switching means connected to a diode. The integral switches are connected in a bridge and an AC voltage is applied thereto. A DC voltage drop detecting means is connected to the output of the bridge for detecting a drop in voltage which will occur if an intruder either open circuits or short circuits one of the integral switches. An overvoltage detecting means is provided for detecting a voltage source which an intruder might insert in the circuit to conceal the removal of an integral switch.

19 Claims, 13 Drawing Figures

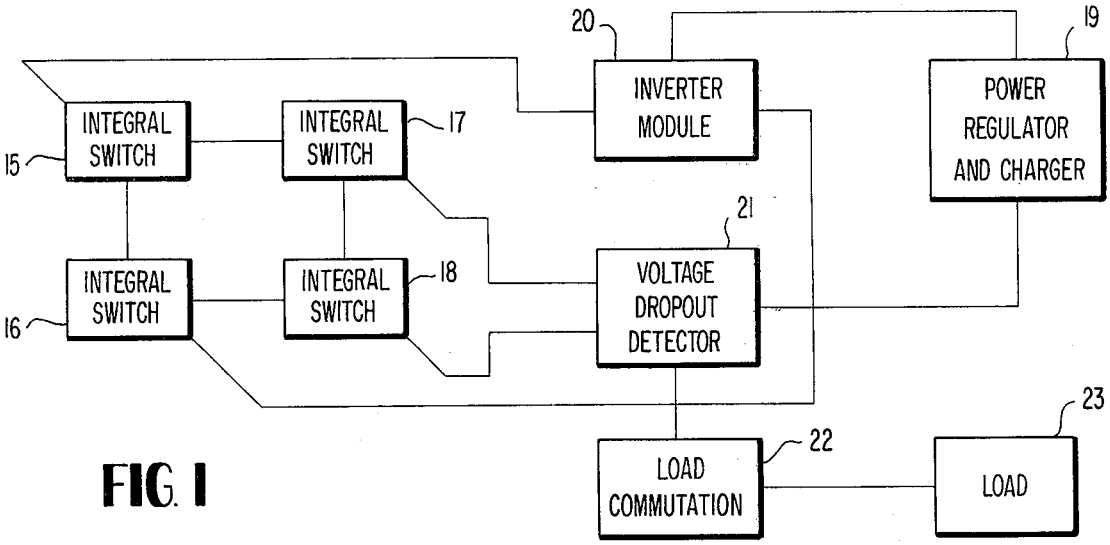
FIG. 1
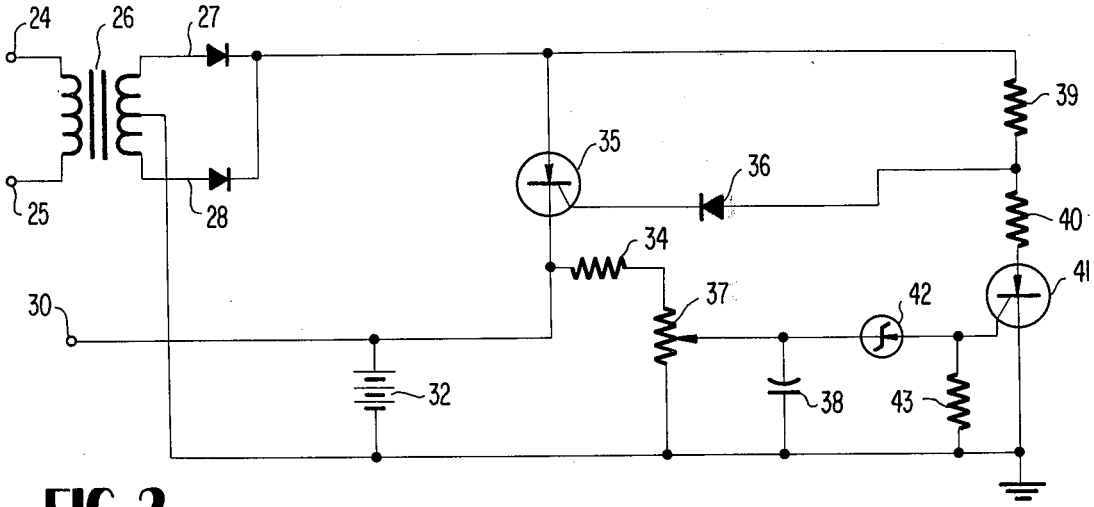
FIG. 2
FIG. 6A
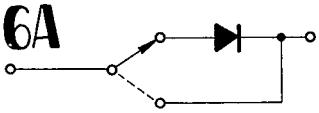
FIG. 6D
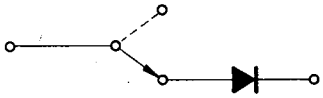
FIG. 6B
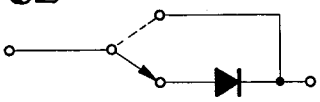
FIG. 6E
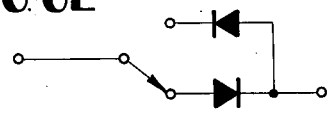
FIG. 6C
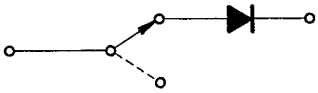
FIG. 6F
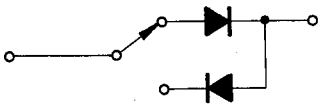

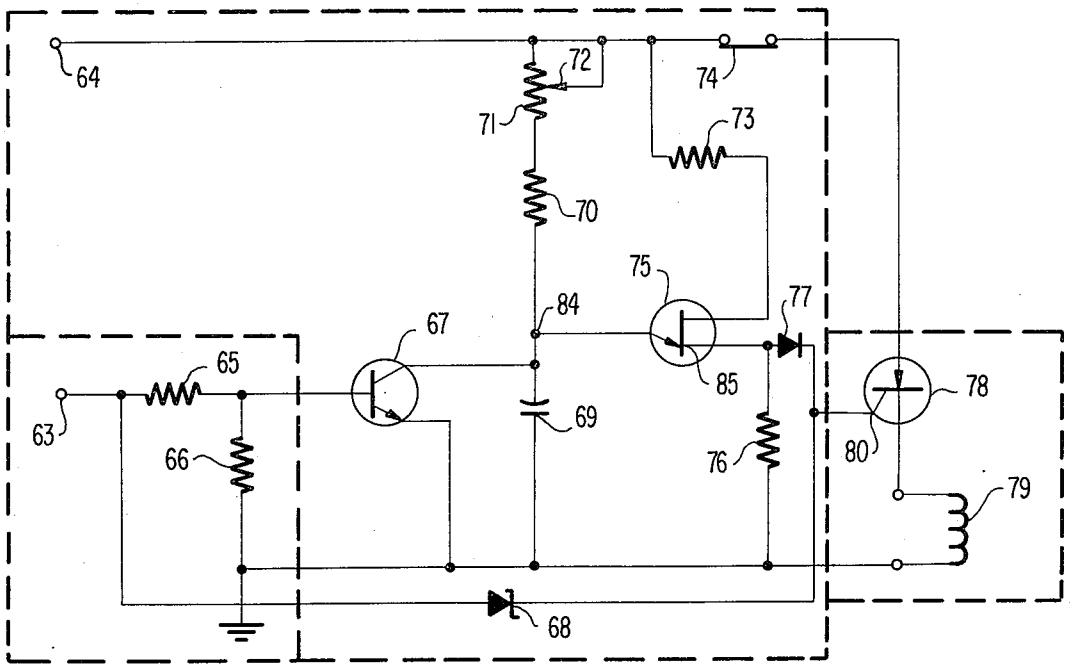
FIG. 4
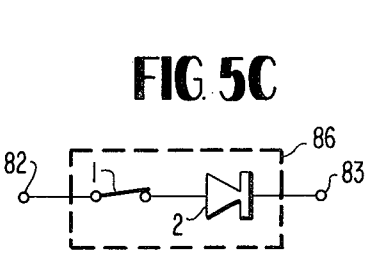
FIG. 5A
FIG. 5C
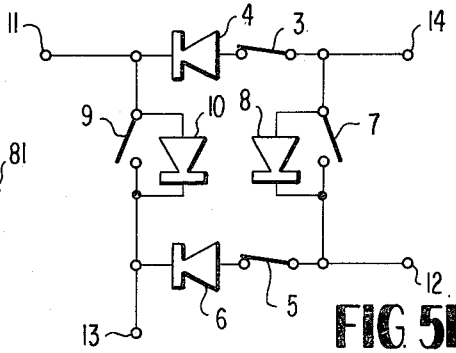
FIG. 5B
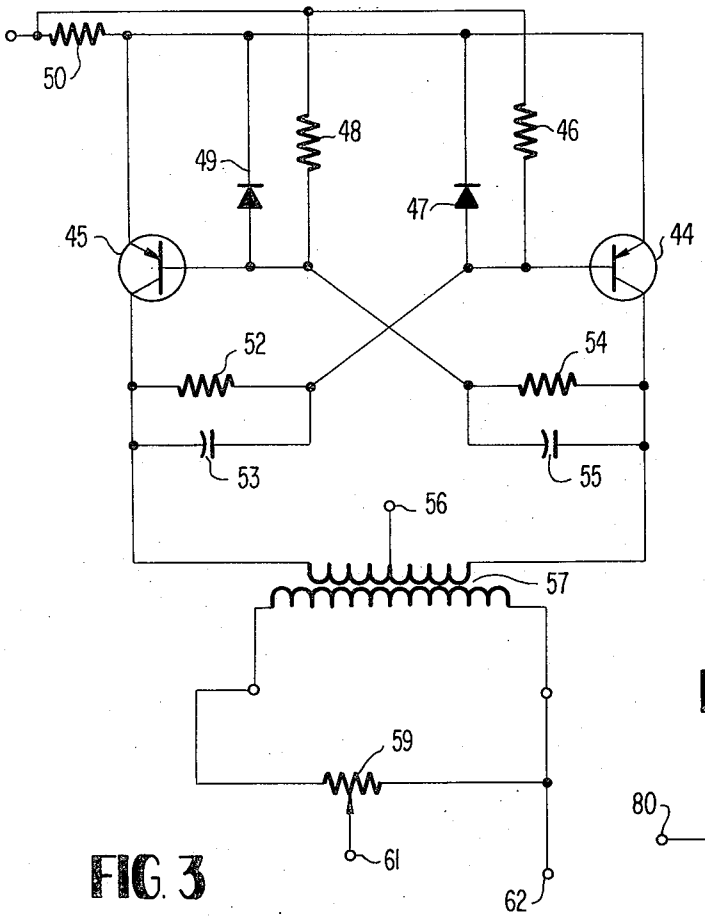
FIG. 3

ALARM SYSTEM WITH SUPERVISORY SYSTEM TO DETECT SEVERING OR BRIDGING OF DETECTION SWITCHES

The present invention relates to an integral switch and to a tamper proof detector circuit for use in an alarm system which circuit utilizes the integral switch.

One problem associated with many alarm systems of the prior art has been that a skilled intruder has been able to render the systems inoperative by disconnecting or shorting the alarm condition sensing switches or the wires which are connected thereto and form part of the alarm circuit. Of course if the intruder is successful he has so to speak "beaten" the alarm system and the whole purpose thereof is defeated.

In the prior art where the alarm condition sensing switches have been normally closed switches it has been possible to defeat the alarm by shorting the normally closed switch either at the switch or remote from the switch so that it remains closed when the alarm condition is sensed. Where the sensing switches have been of the normally open type it has been possible to defeat the alarm system by cutting or disconnecting a switch lead either at the switch or somewhere remote from the switch. Further it is a simple matter for the intruder to determine whether he is dealing with an open or closed switch by measuring across the switch contacts with a voltmeter.

Another disadvantage of some prior art alarm systems has been their sensitivity to supply voltage fluctuations which have sometimes resulted in the triggering of false alarms.

It is thus an object of the invention to provide an integral switch for use in an alarm system.

It is a further object of the invention to provide a relatively tamper proof alarm detector circuit utilizing integral switches.

It is a further object of the invention to provide an alarm apparatus in which fluctuations in supply voltage will not lead to the triggering of false alarms.

Another object of the invention being to protect the exposed wires leading from the integral switch to the control unit from being compromised at any point, adjacent or remote from the integral switch or control unit.

The above objects are accomplished by providing an integral switch which is comprised of a housing which encloses an alarm condition sensing switching means and a diode in circuit connection. The integral switches of the alarm system are connected in DC rectifying bridge arrangements. An AC voltage is supplied to each bridge and a voltage drop detecting means is connected to the output of the bridges to detect a drop in the DC output voltage thereof to trigger the alarm. If an intruder tampers with an integral switch by either open or short circuiting it the output of the bridge will be reduced by at least one half. If the intruder attempts to conceal the removal of a switch by inserting a low impedance voltage source in the circuit means are provided to detect an overvoltage for also sounding the alarm.

A better understanding of the invention may be had by referring to the drawings in which:

FIG. 1 is a block diagram of an alarm system apparatus according to the invention.

FIG. 2 is a circuit diagram of the power regulator and charger shown in FIG. 1.

FIG. 3 is a circuit diagram of the inverter module shown in FIG. 1.

FIG. 4 is a circuit diagram of the voltage dropout detector and load commutation network shown in FIG. 1.

FIG. 5A is a circuit diagram of an integral switch according to the invention including a normally open alarm condition sensing switching means.

FIG. 5C is a circuit diagram of an integral switch according to the invention including a normally closed alarm condition sensing switching means.

FIG. 5B is an embodiment of the tamper-proof detector circuit of the invention.

FIGS. 6A – 6F show integral switches utilizing SPDT switches.

According to the invention integral switches as shown in FIG. 5A and FIG. 5C are provided. Each integral switch is comprised of a housing which encloses an alarm condition sensing switching means and a diode connected together inside the housing.

FIG. 5A shows the circuit arrangement of an integral switch utilizing a normally open alarm switching means 1 which is connected in parallel with a diode 2 which may be a silicon diode. The switch/diode combination is enclosed in a housing 85 an example of which is discussed later in the specification and the leads 80 and 81 are brought to the exterior of the housing so that they are the only part of the circuit accessible from the outside of the integral switch.

The circuit arrangement for the integral switch utilizing a normally closed alarm switching means is shown in FIG. 5C wherein it is seen that switching means 1 is connected in series with diode 2, the combination switch/diode is enclosed in a housing 86 and terminals 82 and 83 are accessible from the exterior of the housing.

FIGS. 6A – 6F show possible circuit arrangements of integral switching utilizing a single pole double throw switching means which may utilize one or more diodes which may be silicon. The various switch diodes may be enclosed in a housing with appropriate leads brought to the exterior of the housing so that they are the only part of the circuit accessible from the outside.

The alarm condition sensing switching means 1 are devices which change state when the alarm condition is sensed. According to the preferred embodiment of the invention the switching means are normally open or normally closed or SPDT (single pole double throw) reed switches which are held open or closed by being in proximity to a permanent magnet which for instance in the case of a burglar alarm system might be located on a window to be protected. The switching means however according to the invention may be any mechanical or electronic switch means which change state when an alarm condition is sensed. The switch means may be connected in known circuit arrangements with alarm sensors such as photocells, thermistors, etc. so that they change state when the alarm condition such as intrusion, smoke, heat, etc. is sensed.

FIG. 5B illustrates a tamper-proof detector circuit according to the invention which comprises a bridge made up of four of the integral switches shown in FIGS. 5A and 5C. While the bridge in FIG. 5B is shown as being comprised of both normally open and normally closed switching means to illustrate that the bridge can be thus comprised, it can of course also be comprised of solely normally closed switches or solely normally open switches. For example in the case where solely normally closed switches are used the bridge configuration would be the same as shown in FIG. 5B except that switches 7 and 9 would be closed and diodes 8 and 10 would be connected in series with switches 7 and 9, respectively, with their respective direction of connection being the same as illustrated.

The switches using SPDT reed, mechanical or electronic switches in FIGS. 6A–6D are wired in the bridge as would be their normally open or normally closed SPST counterparts described above. The switches illustrated in FIG. 6E and 6F consist of SPDT switches and two diodes, one being placed backwards in the circuit to indicate a short or open. For connection in the bridge these integral switches should be treated as analogs of the SPST normally closed integral switches.

As discussed above the object of the invention is to provide a tamper-proof arrangement in which the alarm condition sensing switches and connecting lines may not be rendered inoperative by an intruder. The problem with an ordinary normally closed switch used in alarm systems of the prior art is that it may be bypassed by shorting it so that it will always remain in the normally closed state even when an alarm condition is present. Similarly the problem with an ordinary normally open switch is that one of the wires connected to it may be removed by an intruder thereby rendering the switch inoperative. The integral switch according to the invention cannot be by-passed and any tampering with the wiring at any point attached to the integral switch causes the alarm to sound.

Referring to FIG. 5B an AC voltage is applied to terminals 11 and 12. The switching means 3, 5, 7, and 9 are shown in their normal state which in the case of reed magnetic switches would mean that the switches would be under the influence of magnetic forces. The bridge acts as a rectifying circuit for the AC voltage applied and a DC voltage is outputted from terminals 13 and 14. However if anyone should tamper with one of the integral switches by either open circuiting it, shorting it, or in the case of magnetic switches rendering the magnet ineffective, at least 50% of the DC output voltage will be lost. For instance if one of the integral switches is open-circuited by removing one of the connecting wires thereto or by some other means than the DC output voltage across terminals 13 and 14 will be reduced by a factor of one-half. On the other hand if an integral switch is shorted out then this will cause the entire bridge to see the short and a zero DC voltage will be outputted.

Referring to FIG. 1 the overall operation of the apparatus will be described. Power regulator and charger 19 is a DC power source shown in greater detail in FIG. 2 and the output of which is connected to inverter module 20 and voltage dropout detector 21. Inverter module 20 is a square wave generator such as a cross coupled multivibrator which generates a square wave output which is fed to the bridge circuit previously described and shown in FIG. 1 as the connection of integral switches 15, 16, 17, and 18. The DC output of the bridge is connected to voltage dropout detector 21 which is arranged to detect a voltage drop of predetermined magnitude to activate load 23 which is an alarm such as a bell, siren, lights, telephone, dialing machine, or other known alarm through load commutation network 22.

FIG. 2 is the regulated charging circuit diagram. Terminals 24 and 25 are connected across standard 117v, 60 cycle AC mains to complete the primary circuit of transformer 26. The secondary terminals of transformer 26 are connected to diodes 27 and 28 to form a half wave center tapped bridge which delivers D. C. to SCR 35. If the battery 32 voltage is low SCR 35 is turned on each 180° through resistor 39 and diode 36. Under this condition, the voltage at the wiper of control 37 is less than the avalanche voltage of the Zener diode 42 and SCR 41 cannot trigger. When the battery 32 is nearing full charge, its voltage increases overcoming Zener diode 42, avalanche value and SCR 41 begins to fire each 180°. To begin with SCR 41 fires at $\lambda/2$ radians after the beginning of each half cycle in conjunction with peak supply voltage, charging current and battery voltage. When the battery 32 voltage climbs even higher with continued charging, the triggering angle of SCR 41 increases each 180° until SCR 41 is firing before the input sine wave from the center tap bridge has enough magnitude to fire SCR 35. When SCR 41 is on for the leading 180° the voltage dividing action of resistors 39 and 40 biases out diode 36 so that SCR 35 cannot conduct. Thus heavy charging stops. Charging will begin again when voltage at the wiper of control 37 is less than the avalanche voltage of Zener diode 42 and SCR 41 ceases triggering each cycle. Control 37 may be set so that battery voltage of a 12 volt battery is maintained at 14.0 volts.

FIG. 3 depicts the inventer circuit. The circuit is a cross coupled multivibrator with an untuned load. Current for this circuit is supplied from battery 32 shown in FIG. 2 connected across terminal 56 and resistor 50, a current limiting device. Due to natural inequalities in components, when current is applied to this circuit one transistor will begin conducting prior to the other though were it not for capacitors 53 and 55 both transistors 44 and 45 could conduct simultaneously. Bias voltage is supplied to the bases of transistors 44 and 45 by resistors 46 and 48 respectively. Diodes 47 and 49 protect transistors 44 and 45 from excessive emitter to base voltages when each is off or not conducting. Assuming that transistor 44 is beginning conduction, the emitter to collector current in transistor 44 becomes greater causing condenser 55 to begin to charge. At the same time, the charge in condenser 53 which allowed transistor 44 to begin to conduct is rapidly dissipating into the base of transistor 44. By the time condenser 53 is discharged turning off transistor 44, condenser 55 has enough charge to fire transistor 45. Then, condenser 53 begins charging while condenser 55 discharges into the base of transistor 45. The cycle continues until 53 then charges enough to fire transistor 44 completing one cycle. When transistor 44 conducts a current is drawn through ½ of the primary winding of transformer 37 which abates when transistor 45 conducts, drawing a current through the other ½ of transformer 57 primary. This alternating conduction is seen or reflected across the secondary terminals of transformer 57. Variable resistor 59 is used to match the output of transformer 57 to the load presented by the integral switch bridge.

FIG. 4 is a circuit diagram of the voltage dropout detector and load commutation network of FIG. 1. The DC output of power supply 19 is connected to terminal 64 and the DC bridge output at terminals 13 and 14 in FIG. 5B is connected between terminal 63 and ground. Resistors 65 and 66 form a voltage divider for the incoming signal and an LC circuit may supplement or replace the voltage divider circuit if filtering is desirable. For instance it may be necessary or desirable to tune-out interfering signals such as ham radio signals or signals generated by neon lights. The DC voltage across resistor 66 is applied to the base of transistor 67.

Capacitor 69 is charged through resistors 70 and 71 continuously. In the presence of the proper DC voltage at point 63 transistor 67 will discharge capacitor 69 in a periodic manner so that the voltage at the emitter of unijunction transistor 75 will not reach the peak point and neither the unijunction transistor 75 nor the SCR 78 will trigger. Should the voltage at point 63 decrease below a preset value, transistor 75 will trigger, delivering a pulse train through diode 77 to the gate of SCR 78 which turns on SCR 78. Once triggered SCR 78 remains on until turned off by reset switch 74. The SCR 78 comprises the load commutation network 22 of FIG. 1 and the current flowing through the SCR also flows through alarm load 79 which may be a bell or other known alarm and which is activated by the current flowing therethrough. As known to those skilled in the art specific components in the circuits and the biasing effected thereby may be adjusted so that any predetermined drop in voltage at terminal 63 is effective to activate the alarm.

The unijunction transistor is biased so that the pulse train at the gate of SCR 80 is not great enough to trigger the SCR unless the supply voltage at terminal 64 is what it should be. Thus in some prior alarm systems a sudden decrease in the supply voltage has been operative to trigger the alarm. The present arrangement is designed to prevent that situation and in actual embodiment where the voltage applied to terminal 64 was 14 volts, the biasing was arranged so that when the supply fell below 11.5 volts the alarm was rendered inoperative.

In the event that the alarm is triggered the SCR latches on holding the alarm relay closed. The alarm may be reset by a reset switch which is illustratively illustrated at 74 in FIG. 4.

Another feature of the invention comprises the provision of Zener diode 68 to act as an over-voltage detector. Thus an intruder may insert a high voltage, low impedance voltage source across the bridge, for instance to conceal the removal of a switch from the circuit. This higher voltage will be reflected at terminal 63 and will cause the Zener diode 68 to break down thereby triggering the SCR 78 and activating the alarm 79.

When more than one voltage dropout detector is employed as in the case of more than four integral switches, the cathode of the SCR of each detector is connected to the alarm load. In applications employing a number of switching means other than a multiple of four, diodes may be added to the circuit at the input filter to make up the balance of the bridge circuit.

Also, non-integral prior art normally open or normally closed switch means may be integrated into the bridge of FIG. 5B. For example, normally closed non-integral switches in any number may be connected in series in the bridge arm including a normally closed integral switch such as switch ¾ in FIG. 5B. Although these normally closed non-integral switches will not be tamper proof, they may be used in the present invention in areas where tampering is unlikely. Normally open non-integral switches in any number may be connected in parallel across any integral switch in the detector bridge of FIG. 5B. Thus the current invention will easily interface with any existing system of the prior art.

The housing for the integral switches of the invention may take many specific physical forms as is apparent to those skilled in the art. However the essential feature of the housing is that it must totally enclose the connection or connections between the switch means and the diode so that an intruder cannot short or open a switch means by itself but always must also short or open a diode which is effective to unbalance the bridge. One embodiment of a housing which may be used is a tubular plastic container in which the switch and diode are encapsulated with the leads being connected to metal bands which are affixed around the circumference of the tube thus making the integral switch resemble a cartridge fuse which may be plugged into a standard fuse holder. In the alternative or in combination with the above the switch and diode leads may be fed to spade lugs located at the exterior of the plastic container. As noted above other specific physical housings for the switch/diode combination will be apparent to those skilled in the art.

While I have disclosed and described the preferred embodiments of my invention, I wish it understood that I do not intend to be restricted solely thereto, but that I do intend to include all embodiments thereof which would be apparent to one skilled in the art and which come within the spirit and scope of my invention.

I claim:

1. A tamper resistant detector circuit for use in an alarm system comprising a bridge having four arms, each arm being comprised of a switch means for changing state in response to an alarm condition, and a diode electrically connected to said switch, an AC voltage being applied across one diagonal of said bridge.

2. The circuit of claim 1 wherein said switching means are single pole double throw magnetic reed switch means.

3. The circuit of claim 1 wherein the switch means and diode in at least one of said arms are contained in a single housing.

4. The circuit of claim 3 wherein the switch means and the diode are connected in series in at least one of said arms.

5. The circuit of claim 4 wherein said at least said switch means which is connected in series with a diode is a normally closed switch means.

6. The circuit of claim 3 wherein the switch means and the diode are connected in parallel in at least one of said arms.

7. The circuit of claim 6 wherein said at least said switch means which is connected in parallel with a diode is a normally open switch means.

8. The circuit of claim 3 wherein a D.C. voltage drop detecting means is connected across the other diagonal of said bridge.

9. The circuit of claim 8 further including an alarm load, said voltage drop detecting means including electronic means responsive to a DC voltage drop across said other diagonal of predetermined magnitude for turning an electronic switch means on which causes said alarm load to become activated.

10. The circuit of claim 9 wherein an operating voltage is provided to said voltage drop detecting means for the operation thereof, further including means for detecting a drop in said operating voltage of a predesignated magnitude for inhibiting said electronic switch means from turning on when said DC bridge output voltage drop of said predetermined magnitude occurs.

11. The circuit of claim 8 further including an overvoltage detecting means connected across the same diagonal as said voltage drop detecting means, both said voltage drop and overvoltage detecting means being arranged to activate an alarm load means when a voltage drop of first determined magnitude or an overvoltage of second predetermined magnitude is detected.

12. The circuit of claim 11 wherein said overvoltage detecting means includes a Zener diode connected so as to trigger an alarm when the DC output of said bridge exceeds the breakdown voltage of said Zener diode.

13. The circuit of claim 8 wherein said switch means are alarm sensing switch means which change state when an alarm condition is sensed.

14. The circuit of claim 3 wherein two of the diodes are connected in the bridge so as to conduct at the same time and the other two diodes are connected in the bridge so as to conduct when the first two diodes are biased to be non-conducting.

15. The circuit of claim 3 wherein said switch means are magnetic reed switch means.

16. The circuit of claim 3 wherein said bridge arms are connected together at junctions and wherein the diodes in any pair of bridge arms which connect together the junctions across which said AC voltage is provided are connected in opposition to one another.

17. A tamper resistant detector circuit for use in an alarm system comprising a bridge having four arms, each arm including a switch unit comprised of an alarm condition sensing switching means and a diode connected to each other within a single housing, two of the diodes being connected in said bridge so as to conduct at the same time and the other two being connected so as to conduct when the first two diodes are biased to be nonconducting, means for applying an AC voltage across one diagonal of said bridge, and DC voltage drop detecting means connected across the other diagonal of said bridge.

18. The circuit of claim 17 wherein said bridge arms are connected together at junctions and wherein the diodes in any pair of bridge arms which connect together the junctions across which said AC voltage is provided are connected in opposition to each other.

19. A tamper resistant detection circuit for use in an alarm system comprising a bridge having four arms, at least one of said arms being comprised of a switch means for changing state in response to an alarm condition and a rectifying element electrically connected to said switch means, means for applying an AC voltage across one diagonal of said bridge and DC voltage drop detecting means being connected across the other diagonal of said bridge.

* * * * *

UNITED STATES PATENT OFFICE

CERTIFICATE OF CORRECTION

Patent No. 3,997,890 Dated December 14, 1976

Inventor(s) Embry Mayes Kendrick, Jr.

It is certified that error appears in the above-identified patent and that said Letters Patent are hereby corrected as shown below:

Figure 4 should appear as shown:

FIG. 4

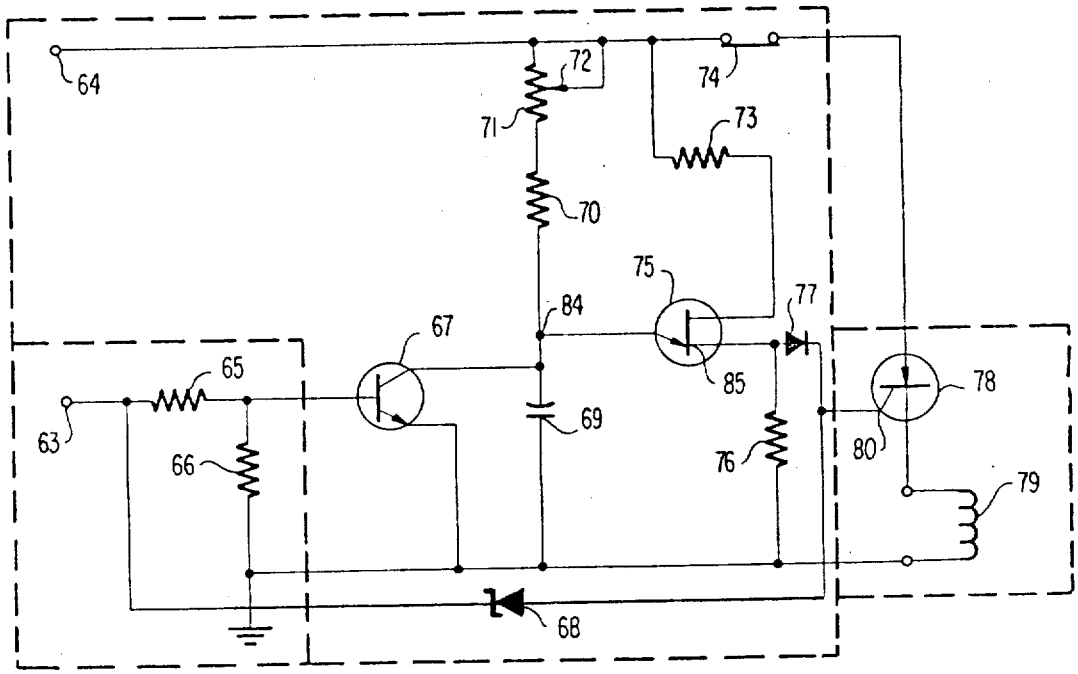

Signed and Sealed this

Seventh Day of June 1977

[SEAL]

*Attest:*

RUTH C. MASON
*Attesting Officer*

C. MARSHALL DANN
*Commissioner of Patents and Trademarks*